US006592150B2

(12) United States Patent
Kernan

(10) Patent No.: US 6,592,150 B2
(45) Date of Patent: Jul. 15, 2003

(54) SKI ROCKER TRAINING DEVICE FOR INSTRUCTING ABLE BODIED AND DISABLED SKIERS

(76) Inventor: Joseph F. Kernan, P.O. Box 680182, Park City, UT (US) 84068-0182

( * ) Notice: Subject to any disclaimer, the term of this patent is extended or adjusted under 35 U.S.C. 154(b) by 0 days.

(21) Appl. No.: 09/917,387

(22) Filed: Jul. 26, 2001

(65) Prior Publication Data

US 2002/0011727 A1 Jan. 31, 2002

Related U.S. Application Data

(60) Provisional application No. 60/221,041, filed on Jul. 27, 2000.

(51) Int. Cl.[7] ..... A63C 11/00

(52) U.S. Cl. ..... 280/809; 280/816; 280/818

(58) Field of Search ..... 280/809, 605, 280/601, 600, 607, 604, 816, 842, 817, 812, 28.11, 818, 14.1; 188/6, 8; 135/66, 71, 77

(56) References Cited

U.S. PATENT DOCUMENTS

| | | | | | |
|---|---|---|---|---|---|
| 339,786 | A | | 4/1886 | Kayes | 280/826 |
| 505,993 | A | * | 10/1893 | Seebick | 188/8 |
| 2,220,634 | A | | 11/1940 | Anderson | 280/606 |
| 2,510,476 | A | | 6/1950 | La Salle | 280/604 |
| 2,593,974 | A | * | 4/1952 | Brown | 188/8 |
| 2,633,365 | A | * | 3/1953 | Cwynar et al. | 188/6 |
| 3,014,284 | A | | 12/1961 | Hall | 434/253 |
| 3,269,742 | A | | 8/1966 | Funyak | 280/606 |
| 3,703,299 | A | | 11/1972 | Kutchma | 280/818 |
| 3,734,523 | A | * | 5/1973 | Field | 188/8 |
| 3,738,674 | A | | 6/1973 | Pauls | 280/816 |
| 3,948,535 | A | | 4/1976 | Negi | 280/816 |
| 3,980,322 | A | | 9/1976 | Schultes | 280/605 |
| 3,992,022 | A | | 11/1976 | Albers | 280/818 |
| 4,101,142 | A | | 7/1978 | Turner | 280/16 |
| 4,152,007 | A | | 5/1979 | Smith | 280/605 |
| 4,219,214 | A | | 8/1980 | Kostov | 280/605 |
| 4,227,708 | A | | 10/1980 | Cote | 280/809 |
| 4,256,319 | A | * | 3/1981 | Winter | 188/8 |
| 4,363,495 | A | | 12/1982 | Henson | 280/14.28 |
| 4,643,444 | A | | 2/1987 | Parkinson | 280/606 |
| 5,277,141 | A | * | 1/1994 | Csepregi | 280/28.11 |
| 5,370,415 | A | | 12/1994 | Humphrey | 280/605 |
| 5,378,156 | A | | 1/1995 | Rohe | 434/253 |
| 5,397,154 | A | | 3/1995 | Baldwin | 280/818 |
| 5,673,772 | A | | 10/1997 | Martin | 188/6 |

* cited by examiner

*Primary Examiner*—Brian L. Johnson
*Assistant Examiner*—Hau Phan

(57) ABSTRACT

A new and improved hand held training device for instructing able bodied and disabled skiers. A gripping bar is attached proximal to the top of a pole member which declines to be attached to a planar member on bottom. The planar member includes a curved up front-end running surface and a normal sliding section for moving the device forward. A rearwardly inclined and extended suspension member attaches and suspends one or more downward extended anti-skid members (fins and adjustable flaps) above and substantially to the rear of the normal sliding section of the planar member. Preferred suspension members include said pole member (which inclines and extends rearward from the planar member), and a rearwardly inclined and extended addition to the planar member. To operate, able bodied skiers use one device having a crossbar on top. Whereas, disabled skiers use two devices having a gripping bar and forearm cuff.

19 Claims, 6 Drawing Sheets

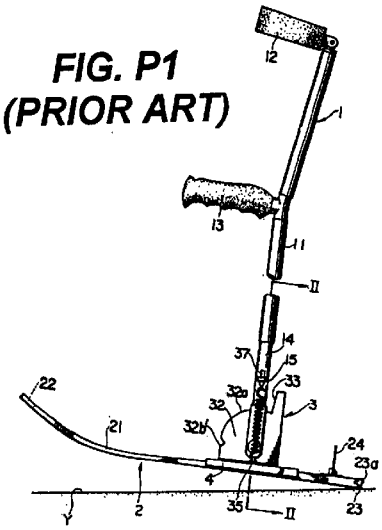
FIG. P1
(PRIOR ART)
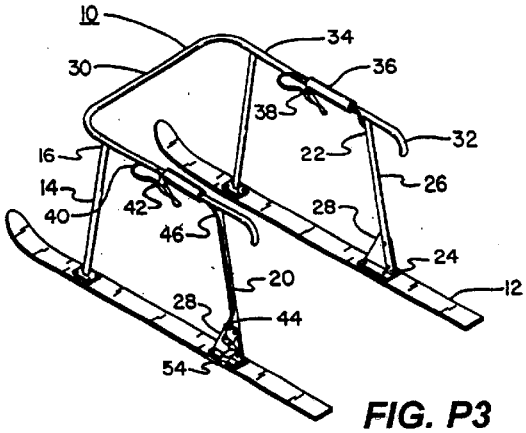
FIG. P3
(PRIOR ART)
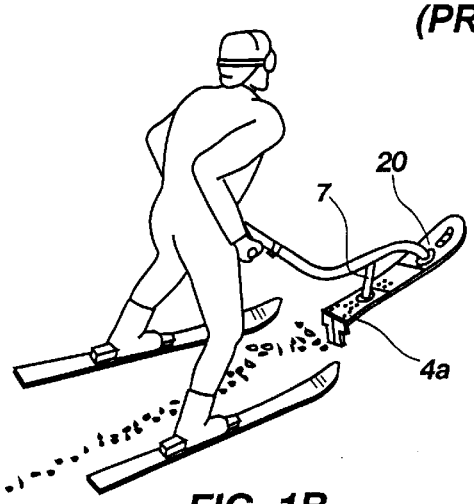
FIG. 1B
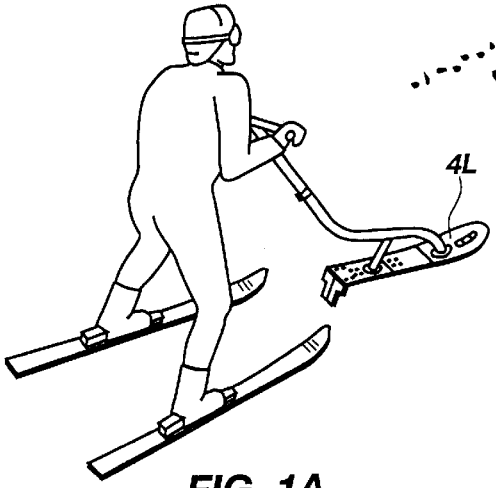
FIG. 1A
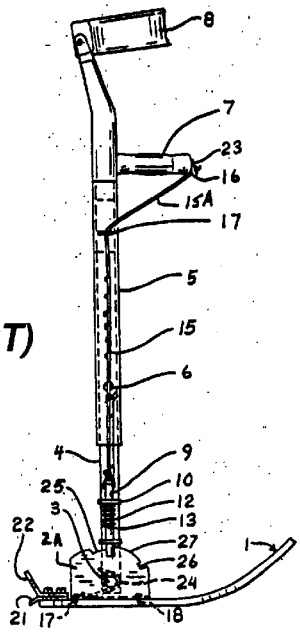
FIG. P2
(PRIOR ART)

FIG. P4
(PRIOR ART)

SKI ROCKER TRAINING DEVICE FOR INSTRUCTING ABLE BODIED AND DISABLED SKIERS

CROSS REFERENCE TO RELATED APPLICATIONS

Continuation in part (CIP) of provisional Patent Application (App. #60/221,041), titled Ski rocker training device, filed on Jul. 27, 2000.

BACKGROUND

1. Field of Invention

This invention relates to downhill skiing and other sliding sport activities, specifically to a training device that assists the user with maneuvering and controlling speed.

2. Description of Prior Art

FIGS. P1–P3

Skiers and other sliding sport enthusiasts begin their sport without the ability to control their speed, and, or their direction of travel. This lack of control causes embarrassment, anxiety, and sometimes injury. Beginners frequently fall hard on the ground or slide out of control. Beginners often slide near and into people, or obstacles. Most beginning siders first learn to control their speed with a braking wedge maneuver, and later learn to control speed with turning.

Braking Wedge

For speed control, most professionally certified ski instructors in the United States (certified through the Professional Ski Instructors of America) presently teach beginners the braking wedge, formerly called "snow-plow", before teaching turning. The braking wedge is the main goal of most initial skiing lessons. It requires the beginners assume an awkward position. A braking wedge is not easy to accomplish. The following paragraphs demonstrate why the braking wedge maneuver is unsatisfactory for most beginning skiers:

To perform a braking wedge, the skier arranges their ski tips near one another and positions the tails wide apart, creating a "V" like position with their skis. This pigeon toed and legs spread wide apart position is uncomfortable. In a braking wedge, skiers use a combination of axial forces and surface drag to slow down. The "V" half angle of wedged skis is typically 30° degrees or less. Axial braking forces result from the lateral force times the angle of skis. Thus, only one half of any lateral force is converted into a useful braking force. Insufficient braking encourages people to rail a ski (over-edging it so that it stops slightly laterally). One railed ski may cross over the other ski, or create unwanted travel in the direction that the railed ski is pointing. Adequate surface drag is also difficult to create, especially on icy slopes, steep slopes, or once a beginner has sped up. Drag is created by maximizing the area of the ski that contacts the supporting surface in a laterally displaced manner across the slope. Basically, the skier increases their wedge angle and flattens their skis by supinating (rolling out) their ankles to create more surface drag. This positioning of the body isn't basic for beginners.

Beginners often irritate their knees trying to twist a ski railed while attempting the braking wedge. It is difficult for a tense beginner to lift, or flatten, and correctly reposition a railed ski. To ski straight while braking in a wedge, the skier must maintain their skis in a sufficiently wide wedge stance, with appropriate edge, and create the same friction and drag on each side. Additionally, the wide braking wedge position can result an unexpected split. Many novice skiers abandon the sport after several hours of practice. Other potential skiers never want to try skiing.

The relevant prior art reviewed below concerns training devices that purport to assist skiers with turning and/or controlling speed. Prior art is crowded with braking devices that purport to solve problems with performing the braking wedge, or otherwise controlling speed. Some devices purport to assist with turning as well as braking. Applicable prior art braking devices include devices that help skiers perform a braking wedge, skier-activated braking systems, harness and pole braking systems, and ski-equipped crutches. All these training devices have significant disadvantages. Several prior art snow vehicles are included at the end of the prior art even though none disclose training devices for beginner skiers.

Prior Art Braking Devices

Braking devices that have uses other than providing a moving skier with speed control have been included for completeness because their titles suggest that they are be related. There are two categories of non-applicable ski brake devices. U.S. Pat. No. 3,980,322 is one of a large number of patents residing in prior art listed that relate to devices which prevent a ski from running away from the skier downhill after the binding opens as the skier falls. Such devices have a usefulness which is limited to stopping a run away ski. U.S. Pat. Nos. 2,510,476 (La Salle, 1950) and 4,219,214 (Kostov, 1980) are representative of patents residing in prior art which disclose blade devices mounted to skis and moveable for downward entry into the snow upon which the users skis are operated. Most typically, such devices are employed as brakes during a prior to upward climbing motions to retard a rear slippage of the skis. Such devices have a usefulness which is generally limited to walking or climbing where the skier moves the skis from static starting positions as they climb, not to downhill skiing. If used for slowing skiers, these devices would have the same problems as those listed under the following hand and leg activated devices.

Hand and Leg Activated Braking Devices

Several prior art braking devices provide speed control for skiers with the engagement of probes, flaps or other braking members that dig into the snow. Most devices are attached to or built into the users skis. The brakes are activated by hand held brake layers, ski poles or by rolling the skis onto their edges. U.S. Pat. No. 4,227,708 (Cote, 1980) relates to a plate fixed on the upper surface of a ski. The plate is provided with a notch into which the lower end of a ski pole may be inserted to produce drag against the snow. While the primary purpose of this device is to provide walking traction during cross country skiing, it purports to provide active braking for a cross-country skier moving downhill. It would be difficult for a beginner to pierce the pole tip through the notch while moving. Additionally, the ski pole applies drag only on the outside of each ski while braking. This would tend to spread the tips of the skis, making the skis more difficult to maneuver. U.S. Pat. No. 4,152,007 (Smith, 1979) provides snow flaps that dig down into the surface at the rear ends of skis. They are activated by hydraulic pressure controlled through the grips on the ski poles. Because the flaps in this device are at the rear of the skis, behind the center pivot point of the skis, it interferes with the skiers rotational efforts to pivot their skis left and right about the axis of their leg.

Devices Built Into One'Skis

U.S. Pat. Nos. 4,986,561(Humphrey, 1991); 4,911,461 (Humphrey, 1990); 5,145,200 (Humphrey, 1992); and 5,370,415 (Humphrey, 1994) provide ski control systems built into the users skis, where probes are deployed out of the running surface of the skis into the snow surface. They purport to achieve enhanced maneuverability and speed control when downhill skiing. First, the probes are too short to be practical in all conditions, such as soft powder or slush. Furthermore, these devices, like all braking systems that deploy braking members from the users snow skis, cause beginners to develop a non-functional back leaning stance. Skiers quickly establish a preferred for-aft stance when learning to ski. It is best to learn a centered stance, leaning neither forward or backward on the boot cuff, by letting the shins barely touch the forward tongue of the ski boots. As the brakes are engaged on these devices, skiers will lean back to resist to the increased pressure on their leg muscles. Novice skiers can get stuck in this bad habit of leaning back while skiing.

Alteratively, skiers can be taught to lean forward against the cuff of their rigid modern ski boots when engaging the probes. But, this encourages the skier to learn a bad habit of leaning too far forward with their stance. Pressure on the front of the ski can make one's ski tail wash out at the end of a turn, resulting in a skier pointed up hill and about to slide backwards. A skier could avoid leaning fore or aft by using the quadriceps muscles to resist the braking force, but this would be tiring. A skier's first experience with their front to back orientation remains fairly permanent and difficult to progress intermediate or advanced skier. Additionally, the braking skis do not operate like traditional skis. The various braking members built onto the skis interfere with the normal pivoting, skidding, and edging operation of one's skis. People who learn on skis with braking members must later relearn how to operate a normal pair of skis.

Some prior art devices assist users with performing a braking wedge. These are devices that connect the front of a skier's two skis by the tips to help students perform a braking wedge and purport to assist them with turning, including U.S. Pat. Nos. 3,703,299 (Kutchma, 1972) 3,992,022 (Albers, 1976) 4,363,495 (Henson, 1982) and 4,643,444 (Parkinson, 1987). Devices that force skiers into a wedge by holding the tips together can cause bad habits. A person who learns to slow down with a wide braking wedge builds muscle memory of the wide position. The skier may find it difficult to change to a smaller wedge, which is much more functional for turning and for becoming a parallel skier. The braking wedge encourages some beginners to assume an incorrect stance, leaning back on their stiff ski boots, pressuring the back of their skis. Leaning back is one of the hardest habits to correct. Additionally, a device that connects the tips does not allow beginners to open their ski tips for skating, or for a parallel positioning of their skis. Beginners use a parallel positioning when traversing a hill, in a lift line, or on flat areas. Basically, devices that are attached to the users skis interfere with the normal operation of the beginners skis when turning, walking and side stepping. These devices do not allow skiers to learn how to use standard skiing equipment.

A variety of two person harness or pole systems enable an instructor to help a student to slow down. These include U.S. Pat. No. 3,014,284 (Hall, 1961) and U.S. Pat. No. 5,378,156 Rohe, 1995). An instructor must be connected to the student to help them turn or slow down. These devices stifle independent learning because they do not allow beginners to control their own speed and direction of travel. The student must be comfortable submitting control to an instructor. One instructor is unable to provide speed control for several students at once. Thus, it is necessary for each student to have a private instructor.

Stabilizer

U.S. Pat. No. 5,397,154 (Baldwin, 1995) is a stabilizer device for skiers. (See Prior Art FIG. P3) This device is bulky, and thus it would be difficult to transport up a ski lift. When braking the user would tire their hands and arms while hanging on and gripping the hand brakes. The user is unable to resist the braking forces with skeletal support of their extended arms, or by resting their hands against their body. The stabilizer has limited turning capabilities which could only be accomplished with drag by engaging a brake on one side. The depth that the brakes can penetrate is limited, and thus the device may not penetrate sufficiently to slow the user in soft snow conditions. Additionally, the stabilizer device provides limited space for a user to operate their skis.

Ski Equipped Crutches

The closest physical embodiment to my invention is the ski equipped crutch. It is designed for people that have only one leg, or disabled legs, who participate in skiing. The devices are known as ski equipped crutches, crutch skis, or outriggers. The gripping bar and cuff set up on ski crutches presume that the skier will use two devices. Two ski crutches (one under each arm) are typically used by a disabled skiers to provide side to side stability when skiing on one leg or in a sit ski chair. The prior art patterns shown in FIGS. P1 (U.S. Pat. No. 3,948,535 (Negi, 1976)) and FIG. P2 (U.S. Pat. No. 3,738,674 (Pauls, 1973)) are representative of formerly patented ski crutches. The ski crutch shown in FIG. P4 (drawings page 5/6) is representative of modern ski crutches.

Braking with Ski Crutches

Ski crutches have not been developed to provide easy braking. To create enough resistance from the snow to brake with these ski crutches, the rear anti-skid member (flap) must be engaged into the snow surface with ample pressure, at a sufficiently forward angle, and at an adequate depth. Braking member 21 in FIG. P2 is representative of ski crutches that utilize a declined short 45° angled anti-skid member on back. The angled portion of braking member 21 is too short for deep penetration into the supporting surface. This short anti-skid member declines downward from the height of the top of the back of the ski, and thus has the limited vertical distance of the ski's thickness.

These ski crutches are built to avoid accidental braking. The fourth paragraph on page four, line 53, of U.S. Pat. No. 3,948,535 (Negi, 1976) in FIG. P1 reads. "In case it is intended to ski at a substantial speed, it will be noted that the braking power from only a single ski is not enough and that a sufficiently powerful braking power is required to insure safety of the physically handicapped or like skier. Therefore, in such an instance of skiing performanced at some speed the pole member of the present invention is thrusted toward a substantially forward position, . . . ". When braking, the force must be adsorbed by muscles in the arms and shoulders. This causes fatigue. To modulate the amount of braking, the user must extend the crutch ski bases forward various distances, or use their triceps and back muscles to add pressure to the bases. The skier must make drastic movements, reaching far forward to brake effectively. Thus, beginners must remain leaned over in an uncomfortable position if they want to stay ready to stop quickly. This encourages a new skier to developed stance that is hunched too far forward, causing them to balance pressure too far forward on their skis. Additionally, braking with one ski crutch more than the other can cause unwanted turning.

The art of designing ski crutches has largely ignored the braking needs of beginners moving at crawling speeds, in order to serve the needs of experts.

Turning with Ski Crutches

Turning needs of beginners has also been ignored. Modern ski crutches (such as that in FIG. P4) are designed for the turning needs of experts moving at high speeds. In order to turn right, (for example) an expert would move and touch the right ski crutch's planar member at a position forward and to the right, creating a slight drag to initiate the turn. Once the turn is initiated, the expert can control the turn. However, to reduce the possibility of excessive deflection from the planar member at high speeds, most modern ski crutches (including FIG. P4) do not have steel edges on the sides of their planar members. Ski crutches without edges do not provide beginners with enough deflection to assist with turning at slow speeds.

Older prior art ski crutches have edges that create deflection for turning. But, the user can only turn when they are not braking. Beginners desire to brake constantly, including when turning. To slow, a beginner using the ski crutch in FIG. P2 can tip the planar member ski back onto braking member 21. Alternatively, they can tip the ski onto its side edge to turn. However, they can engage the back of the ski (to brake) and the side of the ski (in turn) at the same time. Thus, ski crutches do not offer much help to disabled beginners needing to constantly turn and brake. Accordingly, these devices have not been useful enough to cross over to be serve the needs of non-disabled beginners riding on two skis. The above disadvantages would continue if two legged skiers were to use ski crutches. Additionally, the two ski crutches would interfere with a regular skier's two skis when they are spread out into wide parallel or wedged position. The above ski training devices are representative of those known in prior art.

Prior Art Snow Vehicles (Skis and Sleds)

Prior art snow vehicles have a myriad of designs encompassed by crowded prior art which have been developed for the fulfillment of countless objectives. By way of example, U.S. Pat. No. 3,269,742 to Funyak et al. (1966) discloses a riding ski; U.S. Pat. No. 4,101,142 to Turner (1978) discloses a snow sled turning mechanism; U.S. Pat. No. 5,673,772 to Martin (1997) discloses a snowmobile braking system; U.S. Pat. No. 505,993 to Seebick (1893) discloses a coasting sled; U.S. Pat. No. 2,593,974 to Brown (1952) discloses a ski sled; U.S. Pat. No. 2,633,365 to Cwynar et al. (1953) discloses a ski scooter and sled; U.S. Pat. No. 4,215,319 to Winter (1981) discloses a toboggan; U.S. Pat. No. 3,734,523 to Field (1973) discloses a sled; U.S. Pat. No. 5,277,141 to Csepregi (1994) discloses an ice and snow surfboard. While these devices fulfill their respective, particular objectives and requirements, the aforementioned patents do not disclose a ski training device to aid beginner skiers in learning the fundamentals of skiing.

INDEX OF DRAWING FIGURES

FIGS. P1 to P4 show prior art ski crutches and a prior art stabilizer.

FIGS. 1A to 1E shows the preferred embodiment of the ski training device.

REFERENCE LETTERS AND NUMERALS IN DRAWINGS

Figure 2A:
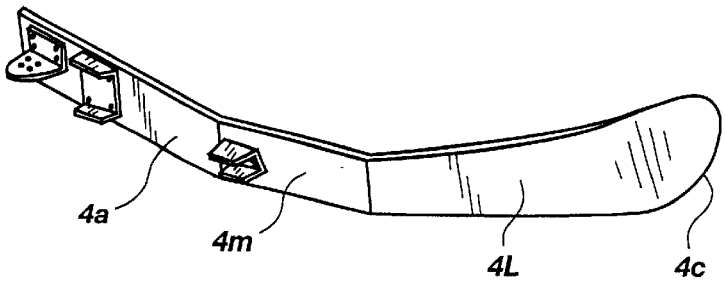
FIGS. 2A, 2B, 2C, 2E and 2F show fin-like and flap-like anti-skid members.

P supporting surface
P' supporting surface
$P_1$ supporting surface
$P_2$ supporting surface
$P_3$ supporting surface
3 anti-skid member
3*a* fin-like anti-skid member
3*b* fin-like anti-skid member
3*e* flat section of inclined extension member
3*f* elongated fin-like anti-skid member
3*g* attachment holes
3*h* inclined and extended section of inclined extension member
3*i* spikes
3*k* prior art anti-skid member
3*m* flap-like anti skid member
3*n* inclined extension member
3*q* flap-like anti skid member
3*r* flap-like anti skid member
3*s* scraping edge
3*s*' scraping edge
3*t* flap-like anti skid member
4 planar member
4' planar member
4*a* planar member inclined aft section
4*b* planar member bending position
4*b'* planar member bending position
4*c* upwardly curved front-end running surface of planar member
4*d* planar member first normal (level) position
4*d'* planar member first normal (level) position
4*d** planar member first normal (level) position
4L normal sliding section of the planar member's running surface
4*m* inclined mid section of planar member
4*s* planar member
4*v* second vertical position of planar member
4*v'* second vertical position of planar member
5 fin-like anti-skid member
5*a* fin-like anti-skid member
5*b* fin-like anti-skid member
6 fin-like anti-skid member
6*a* hole
6*b* hole
6*c* hole
6*d* hole
7 support
7' support
8 curved tube pole sub-member

8' curved tube pole sub-member
**8*h*** curved tube hand position
**8*s*** shortened curved tube pole sub-member
**8*v*** elongated void at top of curved tube
9 hook
**10*a*** flap-like anti-skid member
**10*b*** flap-like anti-skid member
11 clasp
**11*b*** circular bracket
**11*c*** cylinder piece
**11*e*** protrusion
**11*e'*** protrusion
**11*g*** groove
11L lever
**11*p*** threaded pin
**11*s*** screw
12 upper tube pole sub-member
12L lower tube
**12*s*** shortened upper tube pole sub-member
**13*a*** metal reinforcement plate
**13*b*** metal reinforcement plate
14 bolt
15 locking nut
16 gripping bar for right hand
17 "T" center piece
18 gripping bar for left hand
**19*a*** forearm cuff loop
**19*a*** forearm cuff
**19*b*** short gripping bar
**19*b'*** gripping bar
**19*c*** pole sub-member tube
**19*c'*** pole sub-member tube
**19*d*** pin release cord
**19*g*** mount slot
**19*m*** pivotal mount
**19*p*** locking pin
**19*p'*** locking pin
**19*p**** locking pin
20 circular plate
21 circular plate
29 tri-colored decal key
**30*a*** bolt
**30*b*** bolt
**30*c*** bolt
**31*a*** luck nut
**31*b*** lock nut
**31*c*** lock nut
32 crossbar
33 handle bar
34 handle bar
35 down tube

SUMMARY

FIG. 1A TO FIG. 5

Preferred Embodiment

Ski Rocker Trainer

The ski rocker training device has gripping bars, attached to an elongated curved tube member running down and forward to a planar member. The planar member has a forward section with a curved up planar member tip, and has slight bends as it inclines to its mid and aft sections. Downward extended anti-skid members (fins and flaps) are attached and suspended downward from the inclined mid and aft sections of the planar member base, to suspend the anti-skid members to the rear of the normal sliding section of the planar member's running surface. A vertical support strut connects between the aft section of the planar member and the curved tube that declines from the gripping bars to the planar member. The inclined and extended mid and aft sections of the planar member and the pole member with support strut are both inclined and extended suspension members for attaching the anti-skid members.

OBJECTS AND ADVANTAGES

FIG. 1A TO FIG. 5

Preferred Embodiment

Ski Rocker Trainer

Accordingly, several objects and advantages of my ski rocker training device are:

(a) to provide one device that enables beginners to brake while skiing downhill;
(b) to prevent sliding forward or backward when desired;
(c) to help beginners avoid falls and collisions;
(d) to maximise the efficiency of braking forces;
(e) to allow the user to safely and easily modulate the amount of braking;
(f) to provide a training device that takes minimal strength and learning to operate;
(g) to engage the braking device with minor movement;
(h) to minimize strain or exertion of hand, arm, chest, stomach and back muscles;
(i) to allow the user to remain in a fairly upright and comfortable stance when braking;
(j) to allow beginners to practice turning and braking before putting their skis on;
(k) to provide beginners with control from the moment they begin the ski;
(i) to reduce the need for instructors to control a students speed;
(m) to provide a device where the anti-skid members can easily engaged into the snow surface with sufficient pressure, angle, and depth to slow beginners effectively;
(n) to enable instructors to safely lead several beginner students at once down hill;
(o) to encourage a medium width parallel positioning of the skis rather than a wedge;
(p) to avoid the necessity for beginners to learn a braking wedge and its associated problems; (fatigue, splitting one legs, railed skis, sore knees, unwanted misdirection, poor stance, fear, anxiety, embarrassment, and injury);
(q) to avoid unwanted turning when braking
(r) to allow turning with a slight movement of the device;
(s) to assist with turning in various snow conditions;
(t) to prevent interference from device with normal spreading and pivoting of a pair of skis;
(u) to provide a safety mechanism to protect user when encountering obstacles;
(v) to help student learn quicker, so they may control speed through turning;
(w) to encourage correct skiing technique rather than reliance upon the device;
(x) to encourage students to develop their turning technique;
(y) to allow for beginners to use their preferred skis;
(z) to allow students the option of turning without assistance from the device;
(aa) to provide any easy transition from using the device to skiing without it;
(bb) to develop a correct and centered neutral stance rather than a fore or aft lean;

(cc) to minimize the development of bad muscle memories that encourage dysfunctional stances, movement or muscle uses;

(dd) to brake in various snow conditions;

(ee) to encourage the development of the correct skeletal positioning, pressure control; and rotary movements to turn with little effort;

(ff) to promote relaxation, efficiency, and ease of learning;

(gg) to provide immediate gratification to students with reduced learning time;

(hh) to help a fallen skier to get up;

(ii) to be easy to carry the device, or transport it up a ski lift;

(jj) to permit turning and braking at the same time.

Further objects and advantages will become apparent from consideration of the ensuing description and drawings.

DRAWING FIGURES

Figure 5:
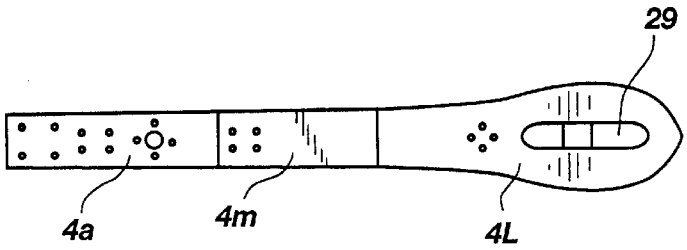
FIG. 5 shows a snowboarder handle bar set up.

FIG. 1A and FIG. 5 show the preferred embodiment of the ski rocker training device and its components.

DESCRIPTION

FIG. 1A TO FIG. 5

Preferred Embodiment

Ski Rocker Trainer

The preferred embodiment of the present invention is illustration in FIG. 1A to FIG. 5. The FIG. 1C ski rocker trainer device has two gripping handle bars 16 and 18 at the top of the device. A declined pole member connects gripping bars 16 and 18 to planar member base 4 down below and forward. From tip to tail, the planar member base in FIG. 1C has an upwardly curved front-end running surface 4*c* that rounds down to the normal sliding section of the planar member's running surface 4L, then a bend to an inclined mid section 4*m,* and another bend to a further inclined aft section 4*a*. The pole member is made up of sub-members including "T" center piece 17, upper tube 12, and curved tube 8. "T" piece 17 in FIG. 1C receives gripping bars 16 and 18, which are welded in piece 17. Then "T" piece 17 receives upper tube 12 and is welded. The "T" center piece attaches the gripping bars substantially perpendicularly to the top of upper tube 12 pole sub-member, forming one elongated crossbar.

Figure 1C:
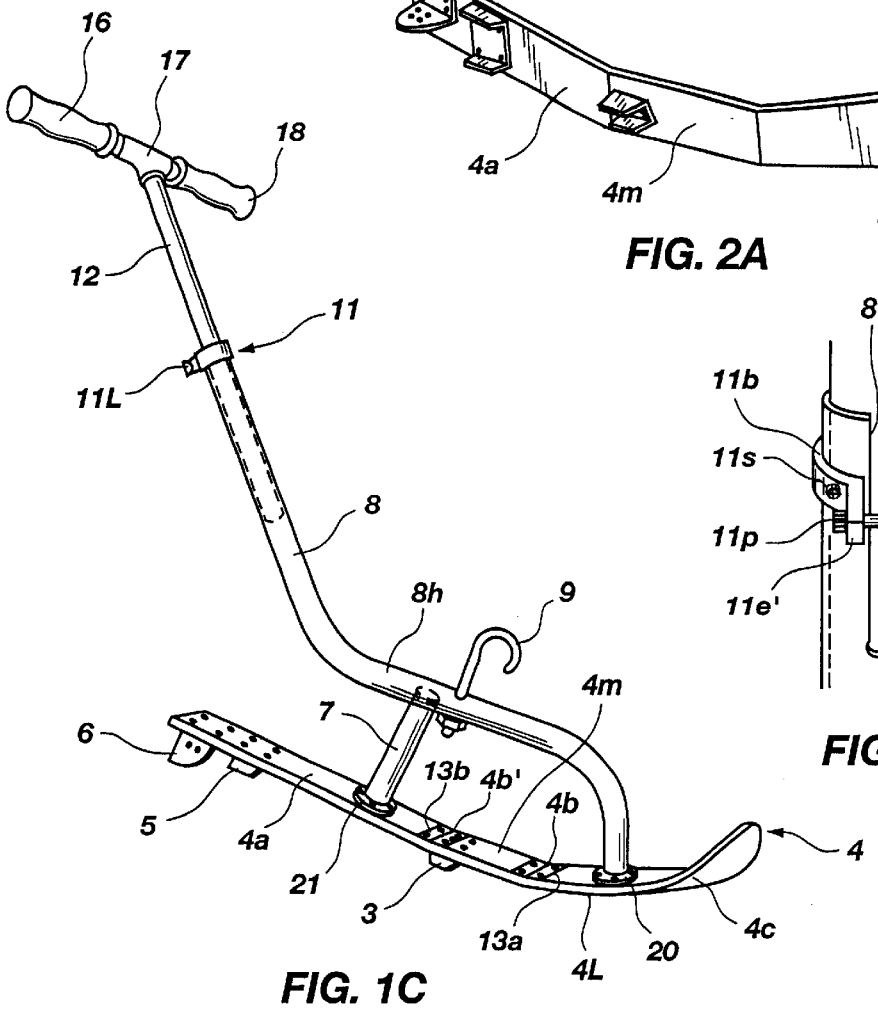
Figure 3:
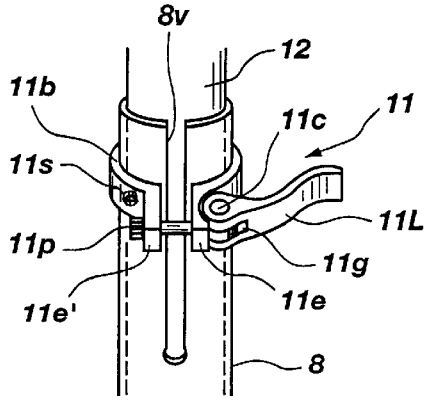
FIGS. 3 and 3T show preferred ski rocker components.

A rubber coated and hooked bolt (hook 9) is attached running through curved tube 8 (near hand position 8*h*) with a nut below as shown in FIG. 1C. FIG. 1C shows upper tube 12 inserted down into curved tube 8 near Clasp 11. FIG. 3 shows that curved tube 8 has an elongated void 8*v* cut vertically from its top inside clasp 11. Clasp 11 includes several pieces. First, circular bracket 11*b* (having protrusions 11*e* and 11*e*') is attached to a hole (not shown) in curved tube 8 with screw 11*s*. Protrusions 11*e* and 11*e'* have holes (not shown) that receive threaded pin 11*p*. Pin 11*p* is convolutely attached vertically inserted core cylinder piece 11*c*. Cylinder piece 11*c* runs through holes in the circular portion of lever 11L above and below (not shown) groove 11*g*. The bottom of lever 11L is a mirror image of the top. Groove 11*g* is a void that cuts across the entire circular cross section of lever 11L.

DESCRIPTION CONT.

FIG. 1A to FIG. 5

The pole member is fixedly attached to the planar member by a convoluted coiling of the bottom of curved tube 8 into circular plate 20, which is then screwed into the top of the planar member ski. Bolts are screwed into threaded receiving holes that are countersunk under circular plate 20 into the top of the planar member. This affixes curved tube 8 in a declined position from the gripping bars to the planar member. An elongated strut-like member, support 7, is convolutedly coiled upward through the underside of curved tube 8. The bottom of support 7 is convolutedly coiled into circular plate 21. Circular plate 21 screwed to aft section 4*a* of the planar member.

A tubular components and pins are made of rigid metal materials. To add additional weight to the ski rocker, the lower portion of curved tube 8 may be filled with lead, iron or another weighty substance. Alternatively, non-permanent weights can be added by placing elongated cylinder weights around rear support 7, or at the bottom of curved tube 8. The planar member base, like modern skis and snowboards, has a plastic layer on its running surface and steel edges along the sides of its base. The rocker-ski was built by cutting of the tall of a modern shaped ski and then incorporating several inclines. The inclines in the FIG. 1C planar member were constructed by cutting across the upper surface downward with a circular saw. Cuts were made across bending positions 4*b* and 4*b'* down to the top side of the plastic layer and steel edges on bottom of the ski. Then, the planar member was bent, glued, and reinforced with small metal reinforcement plates 13*a* and 13*b* to become a rocker-like planar member. Metal plates 13*a* and 13*b* are screwed into the top of the planar member over bending positions 4*b* and 4*b'*.

DESCRIPTION CONT.

FIG. 1A TO FIG. 5

The mid after rearward inclined sections of the planar member base in FIG. 2A show several downward extended anti-skid members attached underneath the base. The inclined and extended mid and aft sections of the planar member are rearwardly inclined and extended additions to the planar member that become a suspension member for attaching the anti-skid members. Likewise, pole member 8 along the support strut 7 is an inclined and extended suspended member for attaching and suspending the anti-skid members. This suspends the fin-like and flap-like anti-skid members from adequately above the supporting surface and substantially to the rear of normal sliding section 4L of the planar member's running surface. FIG. 1C shows that fin-like anti-skid member 3 is suspended from above and substantially to the rear of normal sliding section 4L. Anti-skid members 3, 5, and 6 are extended downward when the planar member is in the FIG. 1A, and FIG. 4A, first normal position resting the normal sliding section of its running surface flat on the supporting surface. The downward elongated anti-skid members engage the supporting surface with substantial depth when minimally rocking back the hand held training device in the second position (FIG. 1B and FIG. 4B).

Figure 1D:
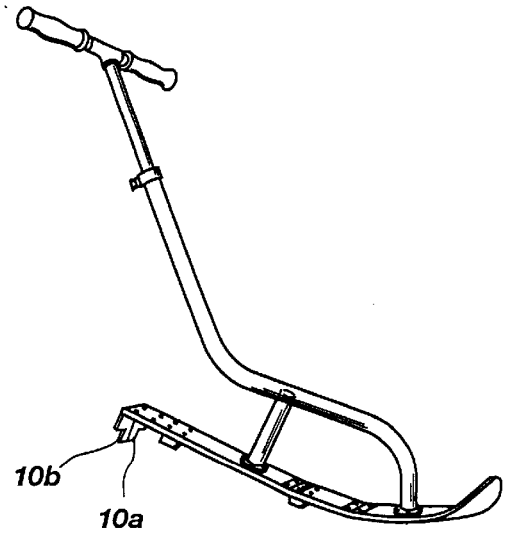
Figure 1E:
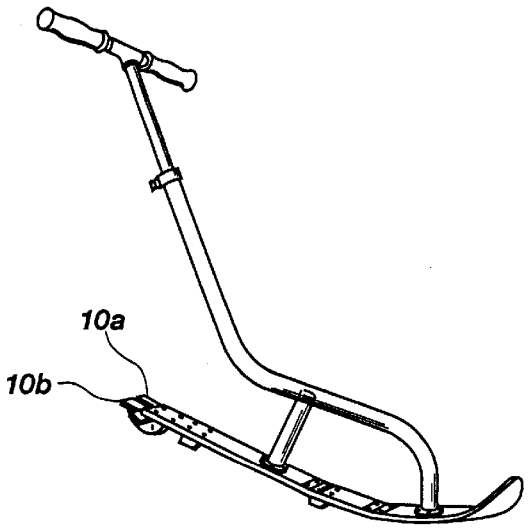
Figure 2F:
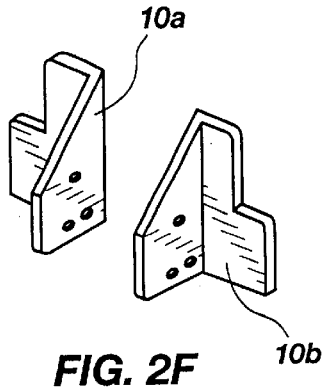
Figure 2B:
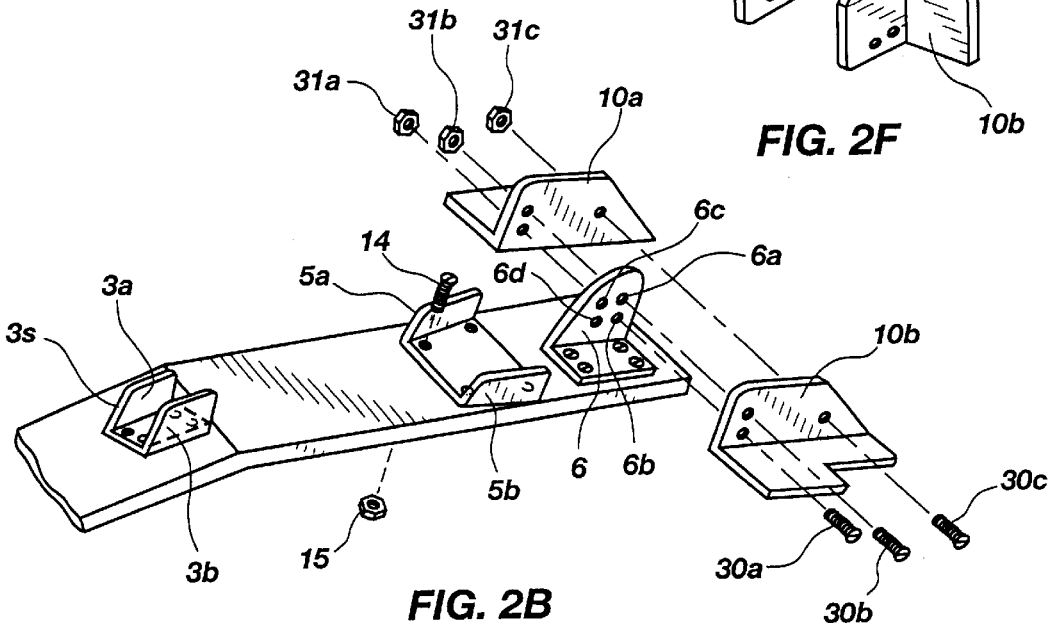

As shown in FIG. 2B, the fin-like anti-skid members (3*a,* 3*b,* 5*a,* 5*b,* and 6) are attached to the base of the planar member with bolts, including bolt 14 and locking nut 15. The fins have scraping edges the point forward, including scraping edge 3*s* of fin-like anti-skid member 3*a*. In FIG. 2B, flap-like anti-skid members 10*a* and 10*b* (also FIG. 2F) are shown to be attached horizontally with bolts 30*a,* 30*b,* and 30*c* plus lock nuts 31*a,* 31*b,* and 31*c* through holes 6*a* and 6*b* in fin 6. Holes 6*b* and 6*d* on fin 6 in FIG. 2B are used to attach the flaps perpendicularly. Flaps 10*a* and 10*b* are shown perpendicular to the planar member in FIG. 2E, and horizontal in FIG. 2C. Flaps 10*a* and 10*b* may also be attached at a forty five degree (45°) angle (not shown) by using fin 6 holes 6*b* and 6*c* for attachment. Flaps 10*a* and 10*b* are also shown attached horizontally on the ski rocker in FIG. 1E (with scraping edges back), and vertically in FIG. 1D, (with scraping edges downward). Although not shown on FIGS. 2A and 1C (to highlight fin 6), it is preferred that flaps 10*a* and 10*b* be included in the preferred ski rocker training device (even if attached horizontally). All the metal anti-skid members are coated with alpine racing wax to prevent snow build up.

DESCRIPTION CONT.

FIG. 1A TO FIG 5

The top of the planar member, as shown in FIG. 5 (top view), includes a tri-colored decal key 929). The decal key is colored from front to back with green, yellow, and then red respectively. The colors correspond with the forward, middle, and aft sections of the planar member that are made to slide fast, slow, or stop respectively. Alternatively, the tri-colored decal may be printed across the top of planar member sections 4L, 4*m,* and 4*n.* The stick figure with a ski rocker in FIG. 4D is in the go-fast (green) position sliding on forward level running surface section 4L. The ski rocker FIG. 4E is shown in the stopping (red) position, engaging its anti-skid members and penetrating aft section 4*a,* while sliding with its underside.

Figure 4A:
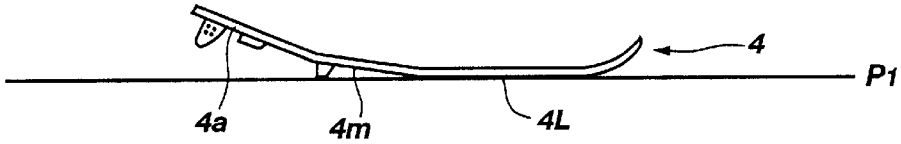
FIGS. 4A to 4E show anti-skid members engaging the supporting surface.
Figure 4B:
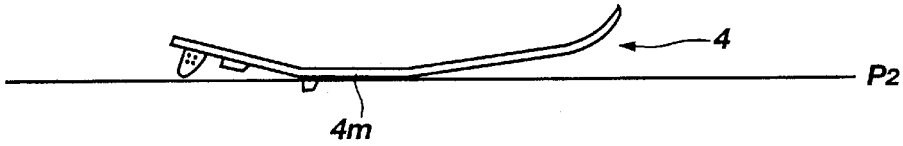
Figure 4C:
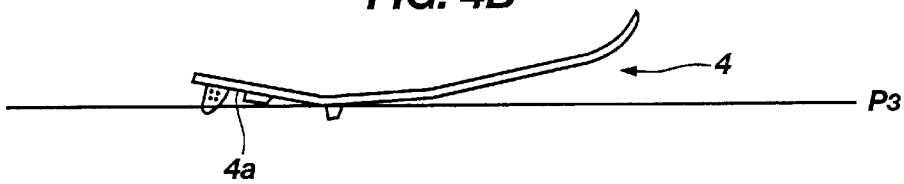
Figure 4D:
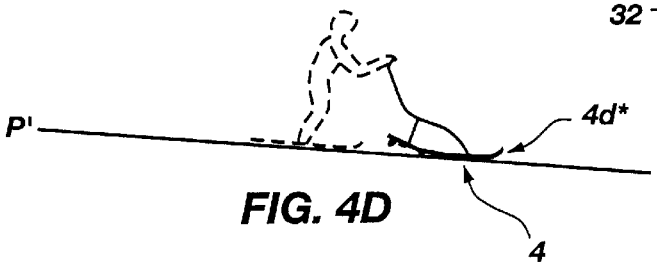
Figure 4E:
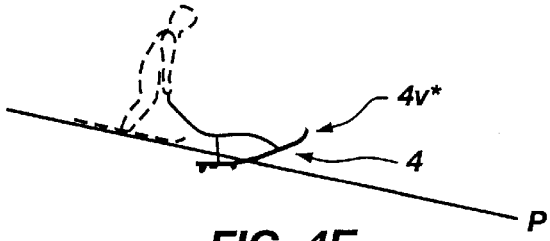

In FIG. 4A through FIG. 4E, planar member 4 is shown from a side view to highlight the engagement of the anti-skid into the supporting surfaces (P, P', $P_1$, $P_2$, $P_3$). FIG. 4D shows planar member 4 in a first normal (level) position 4*d for gliding, whereas FIG. 4E shows planar member 4 in a second position 4*v for braking.

OPERATION

FIG. 1A to FIG. 5

Preferred Embodiment

Ski Rocker Trainer

The ski rocker is held by the user with two hands, and placed out in front of the user as shown in FIGS. 1A and 4D. The ski rocker is used for balancing, turning and speed control. The user rests the running surface of forward section 4L on the supporting surface to glide as shown in FIG. 1A. To brake, the user lowers the gripping bars to engage the anti-skid members under aft section 4*a,* as shown in FIG. 1B. Turning should first be practiced by beginners while walking in their ski boots before they put their skis on. To turn left or right while gliding, the user rotates the handle bars about the axis of upper tube 12. This rotation rolls planar member 4 onto the edge of its forward curved section 4*c* (FIG. 1C), creating deflection for turning. Depending on snow conditions, skiers use the deflection from the engagement of the planar member's sharp edges, built in side-cut, and/or its upward rocker-like are to turn. The rocker-like arc is shown in FIG. 1C starting at the top of the rounded up tip and continuing to bend at the inclinations of the mid and aft sections of the planar member. The user adjusts the amount of handle bar rotation to regulate the amount of deflection for their desired turning radius. For additional planar member deflection, weight may also be added. The weight also makes the ski rocker stand up on its forward sliding surface better. Skiers should use the ski rocker to turn until they have developed the ability to turn with their skis. Then, the ski rocker is guided in front of the user as a back up for turning and speed control until they are weaned off of it. The beginning skier's ultimate goal is to learn to turn with their skis rather than using the ski rocker.

Braking with the Ski Rocker

The user looks at the tri-color label 29 (FIG. 5) to be reminded how to position the ski rocker for slowing or braking. Braking should be practiced by beginners while walking in their ski boots before they put their skis on. As illustrated in FIG. 1B, user should position the gripping bars against their body (on the waist, hips, or thighs) to handle the force of braking without straining their arms. This is like a technique one may use when using their mid-section to push large objects or to slide heavy snow along the ground with a shovel.

OPERATION CONT.

FIG. 1A TO FIG. 5

Figure 2C:
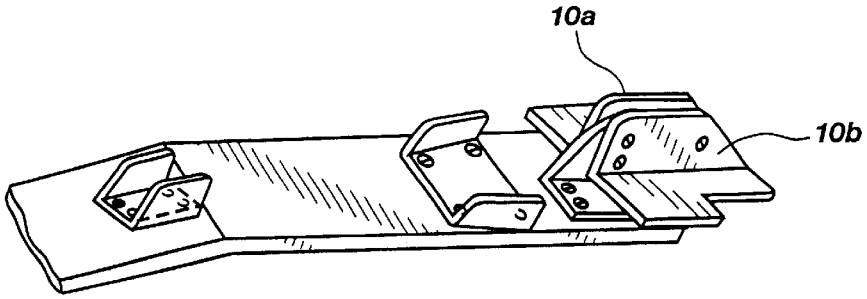
Figure 2E:
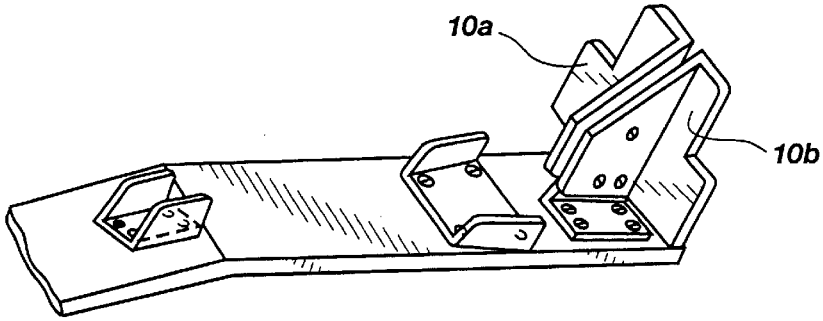

Users brake softly by lowering the gripping bars slightly to only engage the anti-skid members protruding from the bottom of mid section 4*m.* FIGS. 4A, 4B and 4C show that the number of fins that engage the supporting surface ($P_{1-3}$) increases as planar member 4 is rocked back from running on forward section 4L, to the mid section 4*m,* and finally to the aft section 4*a.* Users can modulate the intensity of their braking by rocking the planar member back varying degrees. To stop quickly, the skier lowers the handle bars further to also engage the fins and flaps below aft section 4*a.* To brake in soft snow, users may need to submerge the planar member's aft section (FIG. 4E). To increase the braking capacity of the ski rocker, the flaps may be adjusted downward from their up (horizontal) position in FIGS. 1E and 2C. Rear flaps 10*a* and 10*b* should be positioned horizontally, as shown in FIGS 2C and 1E during hard packed on icy snow conditions. The flaps should be moved at a 45° position for braking on medium packed snow, and to a downward position (FIG. 1D) for braking in soft new snow. Users should practice stopping before starting skiing, while walking in their ski boots.

Braking While Turning

Skiers who turn the ski rocker by rotating the handle bars will likely lean and rotate their upper body towards the side they are turning. This natural response (to lean and rotate to the side that a skier is turning towards) is a dysfunctional technique for developing into an expert skier. The rotating and leaning movements needed for correct skiing technique in described briefly below:

Expert skiers master a technique where they bend and rotate their spine and shoulders away from the direction they are turning. For example, expert skiers bend and twist their skeleton (from the shoulder down) to the right while moving in a semi-circle path to the left. This counter intuitive movement must be learned through extensive practice. It is called "angulation" and "anticipation". Angulation and anticipation allow expert skiers to quickly balance pressure on their outside ski when alternating from turn to turn down difficult slopes.

If skiers do not want to build the bad habit of leaning and rotating into their turns, they should turn with the fins while they are braking. Turning is performed while some fins are at least partially engaged in the supporting surface. Turning with the fins requires much less movement, and can be done without rotation. Like turning bicycle handle bars, the user directs the fins by pushing one gripping bar slightly forward and pulling the other gripping bar slightly back. When practicing turning, flaps 10*a* and 10*b* should be in the up (horizontal position.

Ski Rocker Compensation Functions

The FIG. 1C gripping bars 16 and 18 are used as handle bars to control the planar member below. The "T" center piece 17 is an attachment mechanism for fixedly attaching the gripping bars substantially perpendicularly to the top of the upper tube 12 pole sub-member, as one crossbar to be grasped by both hands. The length of the pole member is adjusted by clasp 11 in FIG. 1C and FIG. 3 (enlarged. Clasp 11 provides friction to affix upper tube 12 within the top of curved tube 8 as the pole member is adjusted to various lengths. The friction of clasp 11 is increased by turning pin 11*p* clockwise. The friction of clasp 11 should be tested and set at a medium tension prior to use. Medium tension will hold the extended pole member while braking, but will allow a collapsing of the pole member if the planar member is suddenly halted by an obstacle (such as a cable sunk in the supporting snow surface). The components of clasp 11 (FIG. 3) function as follows:

Screw 11*s* attaches bracket 11*b* to curved tube 8. Circular bracket 11*b* is tightened by closing lever 11L so that its thicker wheel-like section is wedged between core cylinder piece 11*c* and protrusion 11*e*. This pulls the head of pin 11*p* against protrusion 11*e'* and pulls the pin's shaft further through groove 11*b*, and through protrusion 11*e*. Thus, the lever and pin cinch circular bracket 11*b* by pushing its two protrusions together. This narrows elongated void 8*v* to create friction affixing upper tube 12 within curved tube 8. Groove 11*g* cuts allow the lever to rotate 180°. Cylinder piece 11*c* provides an axis for rotation of lever 11L. Cylinder piece 11*c* runs through the top and bottom (not shown) of lever 11L and is pierced by pin 11*p* at its center.

Ski Rocker Component Functions Cont.

The convolutely attached circular plate 20 and several bolts are the method for mounting the bottom of the curved tube 8 pole sub-member to the planar member base. The mounting is sufficiently tight to permit a user to fixedly lever upward the forward running surface of the planar member to dispose it extending above the supporting surface when rocking the curved tube further back from its normal declined position. Rear strut-like support 7 provides an additional rearward attachment between curved tube 8 and the planar member base. As shown in FIG. 1B, support 7 allows one to load pressure onto aft section 4*a* of the planar member base when braking without having pressure absorbed by flexing of the planar member, or by a loose mount attachment of circular plate 20. Support 7 (connecting planar member 4 to curved tube 8) also provides an additional attachment and suspension of anti-skid members 3, 5, and 6 in FIG. 1C. Metal pieces 13*a* and 13*b* provide integrity to reinforce the bends in planar member 4.

The inclined and extended mid and aft sections of the planar member and pole member 8 with support strut 7 are both inclined and extended suspension members for attaching and suspending the anti-skid members. The mid and aft sections suspend the anti-skid members from a position adequately above the supporting surface, and substantially to the rear of the normal sliding section of planar member's running surface 4L. The anti-skid members are extended downward when the planar member is sliding in the first normal position, resting its normal sliding surface flat on the supporting surface. The user may engage the fin-like and flap-like anti-skid members at a substantial depth into the supporting surface when rocking the training device back minimally.

The skier can use the ski rocker to remove snow from the bottom of their ski boots by scraping against flaps 10*a* and 10*b* (FIG. 1E), or by laying the ski rocker onto its side and scraping. This helps skiers snap into their ski bindings. To get up, a fallen skier may place the ski rocker across the slope at their uphill side and pushed down on 8*h* in FIG. 1C (like pushing down on the arm rest. The ski rocker is carried by grasping at the same position. For transporting the ski rocker up a chair lift, it is attached with hook 9 to the outside of the arm rest (positioning the handle bars in back). Alternatively, the ski rocker may be hung on the chair by hooking the aft section 4*a* after the ski rocker is swung upside down. The lift attendant should assist the skier with hanging and removing the ski rocker. The ski rocker may also assist users involved in other sliding activities including snowboarding, snow skating, cross country skiing, and ice skating. The ski rocker may be used to control a slider on a variety of surfaces including snow, ice, sand, mud, or plastic pellets.

CONCLUSIONS

FIG. 1A to FIG. 5

Preferred Embodiment

Ski Rocker Trainer

From the description and operation above, it becomes evident that may new and improved invention has many novel elements. The two handle bar, the collapsing pole member, the curved tube member, the positioning and design of anti-skid members, and the inclined planar member provide dramatic advantages for beginner skiers. It is simple to use, easy on the muscles, and encourages proper skiing techniques. My ski rocker allows people who have never skied before to practice stopping and turning while they walk in their ski boots. Then, beginners are able to ski down a hill soon after stepping into skis. They avoid spinning considerable time and energy learning various maneuvers, including the difficult braking wedge. Beginning skiers avoid danger and anxiety by being able to control speed and maneuver from the start. The ski rocker training device accomplishes the objectives set forth above.

SUMMARY

FIGS. 6A AND 6B

Additional Embodiment

Disabled Ski Rocker

Figure 6A:
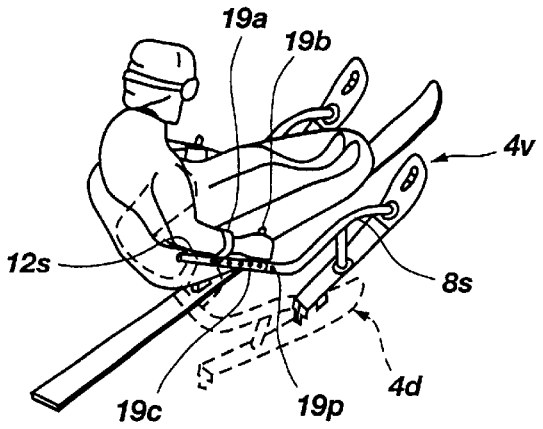
FIGS. 6A, 6B and 6F show a disabled ski rocker and its locking pin.
Figure 6B:
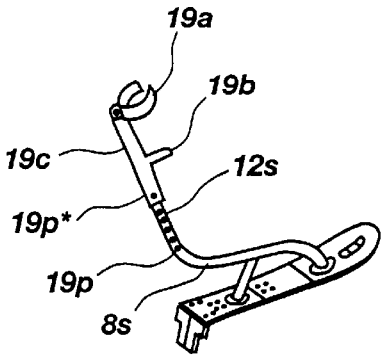

In FIGS. 6A and 6B the preferred ski rocker has been adapted to the sizing, forearm cuff, and gripping bar set up needs of disabled skiers. This ski rocker crutch is recommended for beginning disabled skiers. One crutch equipped ski rocker is held in each hand to the sides of disabled skiers, who are usually riding on one ski.

OBJECTS AND ADVANTAGES

Accordingly, the differences in the objects and advantages of the disabled ski rocker versus the preferred ski rocker training device is below.

The following objects and advantages are not applicable:

(a) to provide one device that enables beginners to brake while skiing downhill;

(o) to encourage a medium width between the skis rather than a wide separation (p) to avoid the need for beginners to learn a braking wedge and its problems;

(t) to prevent interference with normal spreading and pivoting of a standard pair of skis;

(u) to maximize the space with which to maneuver ones skis;

(aa) to provide an easy transform from using the device at first to skiing without it;

Historically, the braking capacity of ski crutches has not been maximized. Handicapped skiers have been taught to use rather than ski equipped crutches to slow down, largely because ski crutches are designed for experts who don't brake often. A ski crutch should allow beginners to brake and turn from the start. The ski crutch should permit the disabled skier to be self sufficient by easily braking on their own. As instructor should not have to use a harness system to help a disabled skier slow down.

Further objects and advantages will become apparent from consideration of the ensuing description and drawings.

DRAWING FIGURES

Additional Embodiment

Disabled Ski Rocker

FIGS. 6A to 6B show disabled ski rockers.

DESCRIPTION

FIGS. 6A and 6B

Additional Embodiment

Disabled Ski Rocker

A rocker training device is shown in FIGS. 6A and 6B. It is constructed much like preferred embodiment (FIG. 1C), except that the regular handle bars have been replaced by a set up designed for the grasping needs of disabled skiers. It includes forearm cuff loop 19*a* and short gripping bar 19*b*. It also includes a pole member made of sub-members. Forearm cuff 19*a* is attached to the top of a pole sub-member tube 19*c*. Welding is the attachment means for fixedly attaching gripping bar 19*b* in a substantially perpendicular manner to pole sub-member 19*c*, at a position proximal to the top of the role member. The curved tube in FIG. 1C was cut down to be shortened curved tube 8*s*. Then shortened upper tube 12*a* (a pole sub-member with holes along its length for lengthening) was attached to shortened curved tube 8*s* with locking pin 19*p* (see locking pin in FIG. 6F). Upper tube 12*s* is then run upward inside the bottom of pole member tube 19*c* and is fixed at chosen lengths by locking pin 19*p**.

Like the preferred embodiment, the disabled ski rocker includes a planar member with anti-skid members that are fixedly attached to the inclined and extended aft section of the planar member, substantially to the rear of the normal sliding section of planar member's running surface.

The anti-skid members are suspended downward from adequately above the supporting surface. The anti-skid members are extended downward when the planar member is in a first normal position resting the normal sliding section of planar member's running surface flat on the supporting surface. Thus, a user may engage the downward extended member at a substantial depth into the supporting surface when rocking the training device back minimally. FIG. 6A shows movement of the planar member from a first normal (level) position 4*d*, to a second (vertical) position 4*v*. The inclined and extended mid and aft sections of the planar member and the pole member with support strut are each elongated suspension members for attaching and suspending the anti-skid members.

OPERATION

FIGS. 6A and 6B

Additional Embodiment

Disabled Ski Rocker

Disabled people use a ski rocker in each hand at their sides while sitting (FIG. 6A) or standing.

The FIGS. 6A and 6B disabled ski rockers are used for balancing, turning, and braking. The disabled ski rocker in FIG. 6B, and its components, function much like the preferred embodiment and its related components. However, length adjustments in the pole member is made by removing pin 19*p, moving upper tube 12***s* within pole sub-member tube 19*c*, and then reinserting pin 19*p. Upper tube 12***s* is extended to be taller for standing disable skiers, or it is retrieved within pole member 19*c* for sit skiers (FIG. 6A). Turning and braking is accomplished in a similar manner as explained in the preferred embodiment previously. At slow speeds, the user can turn with deflection by rotating their arm, and thus rolling the planar member in onto its steel edged side in the desired direction. A user can also brake and turn with the fins. A disabled skier may brake softly by tipping the ski rocker back slightly onto the fins, or brake hard in soft snow by pushing the aft sections of the planar members down into the supporting surface. The fins help the user to avoid unwanted turning to one side when braking. The flaps should be adjusted for various snow conditions as above with the preferred embodiment.

CONCLUSIONS

FIGS. 6A to 6B

Additional Embodiment

Disabled Ski Rocker

From the description and operation above it is evident that my disabled ski rocker has advantages for beginner disabled skiers. The rearwardly suspended and downward extended anti-skid fins and flaps improve steering and braking for beginners. The disabled ski rocker accomplishes the objectives set forth above.

SUMMARY

Figure 6E:
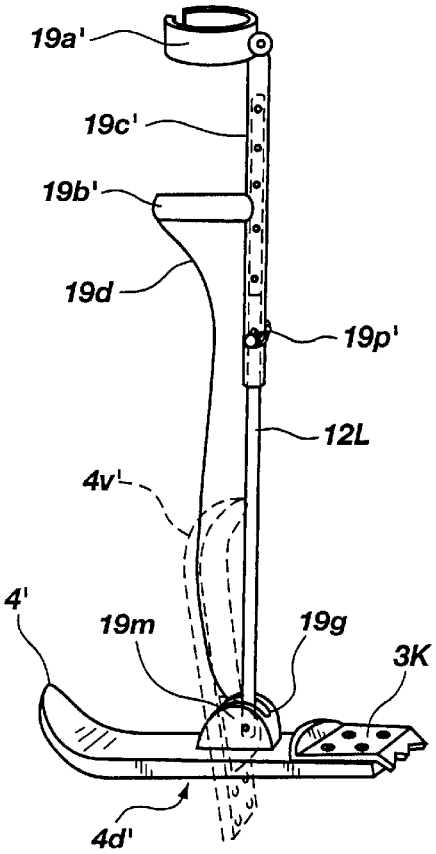
FIGS. 6D and 6E show an inclined extension member improvement for modern ski crutches.
Figure 6E:
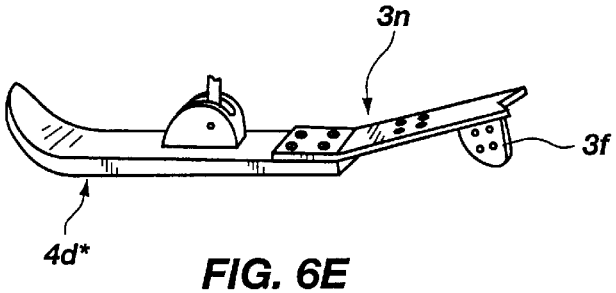
Figure 6D:
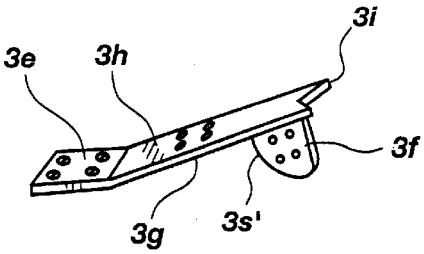
Figure 6F:
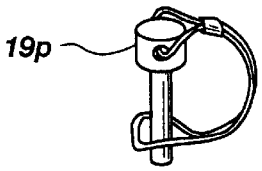
Figure 7:
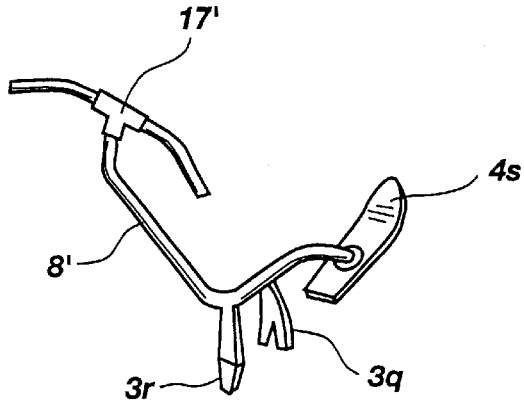
FIGS. 7 through 11 show five alternative embodiments of the ski rocker trainer.

FIGS. 6D and 6E

Additional Embodiment

Crutch Ski Rocker

The prior art ski equipped crutch (FIG. P4) can be adapted to become a crutch ski rocker by substituting my novel inclined extension member (FIG. 6D) with its anti-skid member. The crutch ski rocker is recommended for disabled skiers skiing on one leg, or on a sit ski. It includes a fin for turning, and flap may be added for braking in soft snow. On crutch ski rocker is held in each hand to the sides of disabled skiers.

OBJECTS AND ADVANTAGES

Accordingly, the objects and advantages of the crutch ski rocker are the same as for the disabled ski rocker above.

Further objects and advantages will become apparent from consideration of the ensuing description and drawings.

DRAWING FIGURES

Additional Embodiment

Crutch Ski Rocker

FIGS. 6D and 6E show a novel inclined extension member for converting a crutch equipped ski to a crutch ski rocker.

DESCRIPTION

FIGS. 6D and 6E

Additional Embodiment

Crutch Ski Rocker

Prior Art Plus Novel Inclined Extension Improvement

Prior Art FIG. P4 shows a typical ski equipped crutch used by disabled skiers. The ski equipped crutch includes the following elements: a pole sub-member tube 19*c*', a locking pin 19*p*', a forearm cuff 19*a*', a gripping bar 19*b*', a pin release cord 19*d*, a lower tube 12L, a pivotal mount 19*m*, a planar member 4', and an anti-skid member 3*k*. The pivotal mount permits a levering of the planar member from a normal level position 4*d*', to a vertical position 4*v*'. The pivotal mount has a removable locking pin (not shown) with an elastic resistance mechanism (not shown) that secures the planar member in its first normal position 4*d*', and later in its second vertical position 4*v*'. In vertical position 4*v*', the front end extends upwardly adjacent to the lower tube 12L, with the rear portion of the planar member extended downward. Lower tube 12L pivots within slot 19*g* of mount 19*m* when moving the planar member from normal to vertical positions. The prior art crutch in FIG. P4 includes anti-skid member 3*k* for braking.

To convert the prior art ski crutch in FIG. P4 to a crutch ski rocker, the prior art anti-skid member (3*k*) (having minimal functional braking capacity) is removed and replaced with the novel inclined extension member shown as FIG. 6D. The inclined extension member has four holes on flat section 3*e* (on the end at the bottom of the incline) to be fixedly attached to the aft portion of the planar member. The inclined extension in FIG. 6D includes an inclined and extended section 3*b* with an elongated anti-skid member (3*f*) attached underneath the end at the top of the incline by welding. Fin 3*f* is suspended downward from the extended section, so that scraping edges 3*s*' is positioned pointing forward slightly above the supporting surface. As with the preferred embodiment, anti-skid member flaps 10*a* and 10*b* (in FIG. 2F) may be bolted to fin 3*f* in a horizontal, forty five degree (45°), or vertical manner (with its scraping edge pointed downward) depending on snow conditions. To attach additional anti-skid members, fins 5*a* and 5*b* in FIG. 2B may be bolted under attachment holes 3*g*. The back end of extended section 3*h* has spikes, including spikes 3*i*.

FIG. 6E shows the substitution converting the planar member on the prior art ski crutch to a rocker-like planar member. It shows inclined extension member 3*n* attach to the planar member portion of the prior art ski crutch. Inclined extension member 3*n* is a suspension member, because it is a rearwardly inclined and extended addition to the planar member for attaching and suspending anti-skid member 3*f*. This change permits the prior art ski equipped crutch in FIG. P4 to function as a ski rocker. The novel inclined extension nember with attached anti-skid member attaches and suspends the anti-skid members downward from adequately above the supporting surface. The inclined extension member attaches and suspends the anti-skid member substantially to the rear of the running surface of the planar member. Anti-skid member 3*f* is substantially extended downward when the planar member is in a first normal position 4*d** resting the normal sliding section of planar member's running surface level on the supporting surface.

OPERATION

FIGS. 6D and 6E

Additional Embodiment

Crutch Ski Rocker

To convert to a crutch ski rocker, one attaches the inclined extension member in place of anti-skid member 3*k*. The resulting crutch ski rocker is used for balancing, turning, and braking. Disabled people hold a crutch ski rocker in each hand while skiing in sitting, or standing positions. The crutch ski rocker may be used like a crutch to steady oneself while stationary, or when moving slowly forward in a lift line (much like ski poles are used by traditional skiers). Position 4*d* in FIG. 6E shows how the crutch ski rocker is positioned for gliding.

Turning and braking are accomplished in a similar manner as the preferred embodiment, as explained below.

For turning, the user has several options. The user can made turns by creating drag (also called "friction" turns). This is accomplished by sliding and pressuring the crutch ski rocker on the side of the intended turn in the desired direction. This type of drag turn is preferred for turning at higher speeds. For beginners skiing at slow speeds, it is recommended that users turn while engaging fin 3*f*. Thus, users keep their speed down while turning. To turn, users tip the pole member back engaging fin 3*f*, and then steer in the desired direction. The fin also helps the user to avoid unwanted turning when braking. Because modern crutch skis often lack steel edges, rolling the planar member onto its side is only possible with older crutch skis.

For braking, a disabled skier may tip the crutch ski rocker back onto the fin 3*f*. The fin provides adequate resistance for braking in hard pack now conditions. As with the preferred embodiment, flaps 10*a* and 10*b* (FIG. 2F) should be added and angled downward for softer snow conditions. A user may brake in soft snow by pushing the flaps, or the entire aft sections of the planar members, down into the supporting surface. The design of the inclined extension member brings the anti-skid member closer to bring under the mass of the user. This change allows the user to exert more pressure on the anti-skid members during braking than was possible when prior art flap 3*k* was used. Users may engage the downward extended anti-skid members at a substantial depth into the supporting surface when rocking the device back.

CONCLUSIONS

FIGS. 6D and 6E

Additional Embodiment

Crutch Ski Rocker

From the description and operation above, it is evident that my inclined extension member converts existing ski crutches to crutch ski rockers. The rearward suspended and downward extended anti-skid fins and flaps improve steering and braking for beginner and intermediate skiers. The improved crutch ski rocker reserves its uses as a ski crutch, while enabling the user to brake and turn more effectively. The crutch ski rocker accomplishes the objectives set forth above.

SUMMARY

FIGS. 7 to 11

Alternative Embodiments of the Ski Rocker Trainer

FIGS. 7 to 11 shows ski rockers having various attachment mechanisms, or inclined and extended suspension members, for suspending anti-skid members from the planar member, and/or from the pole member. The alternative embodiments include five of the numerous methods for suspending downward extended anti-skid members from above and substantially to the rear of the normal sliding section of the planar member.

OBJECTS AND ADVANTAGES

Accordingly, the objects and advantages of these ski rockers are the same as the preferred ski rocker training device.

Further objects and advantages will become apparent from consideration of the ensuing description and drawings.

DRAWING FIGURES

FIGS. 7 to 11

FIGS. 7 to 11 shows five alternative embodiments of the ski rocker.

DESCRIPTION

FIGS. 7 to 11

Alternative Ski Rocker Embodiments

There are numerous embodiments of a ski rocker and many methods for attaching and suspending its anti-skid members. The devices in FIGS. 7 to 11 are designed within specific parameters to be ski rocker training devices. Each device has a gripping bar for at least one hand, attached to a declined pole member running down and forward to be attached to a planar member, and further including at least one downward extended anti-skid member attached by inclined and extended suspension member to position the anti-skid member above and substantially to the rear of the normal sliding section of planar member's running surface. The design of the inclined and extended suspension members include rearwardly inclined and extended planar members in FIGS. 8 and 10, plus pole members that act as rearwardly inclined and extended suspension members in FIGS. 7, 9, and 11. The gripping bars can vary in their positioning, as long as they are attached proximal to the top of the pole member.

Figure 8:
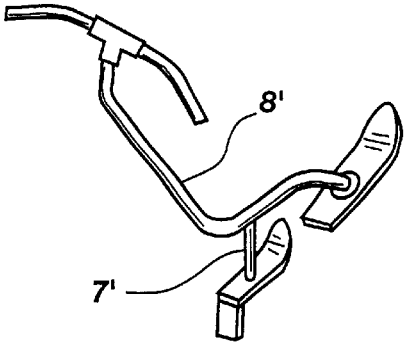
Figure 9:
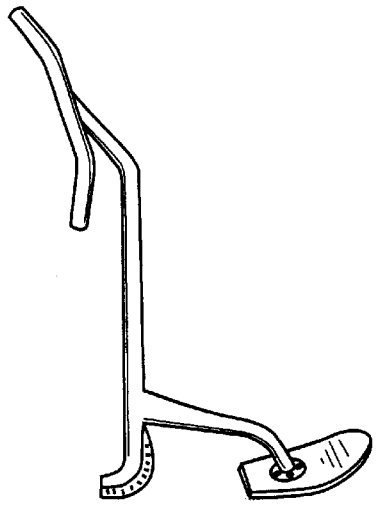
Figure 10:
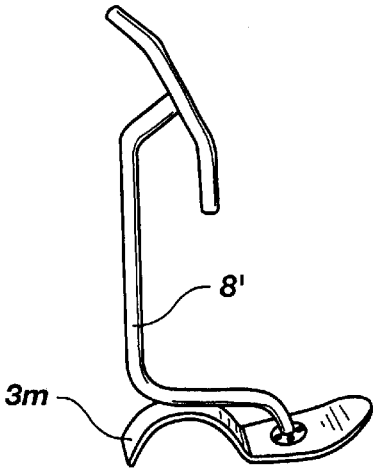
Figure 11:
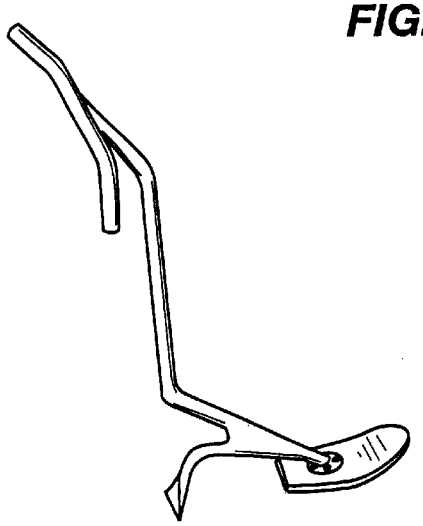

These alternative embodiments are constructed much like the preferred embodiment. The FIGS. 7 and 8 ski rockers have two gripping bars welded to "T" center piece 17' (a pole sub-member), that is welded to curved tube 8' (an elongated pole sub-member), which is attached to the planar member below. The ski rocker in FIG. 7 includes anti-skid member flaps 3*q* and 3*r*, which are attached by welding means directly to curved tube 8'. These flap-like anti-skid members are suspended to the rear of the normal siding section of planar member's running surface 4*a*. In FIG. 8, the ski rocker includes two planar members attached in line to curved tube pole member 8'. Support 7' is an sub member of elongated suspension and pole member 8', which fixedly attaches and suspends the rear planar member and anti-skid member 3*t* to curved tube 8'. Flap-like anti-skid member 3*t* is suspended from above and substantially to the rear of the normal sliding section of the planar members' running surfaces. The ski rockers in FIGS. 9 to 11 have one elongated crossbar-like gripping bar welded across the to of the pole member. Each gripping bar includes several bends to form typical handle bars. The anti-skid members in FIGS. 7, 9 and 11 may be molded as part of the inclined and extended suspension and pole members, which fixedly attach and suspend downward extended anti-skid members. The anti-skid members on FIGS. 9 and 11 are attached to and built-in during manufacturing as part of the modified curved tube pole sub-members. The anti-skid member on FIG. 9 is fin-like, whereas the anti-skid member on FIG. 11 is flap-like. The FIG. 10 ski rocker includes flap-like anti-skid member 3*m*, which is attached and suspended as the back end of an arching planar member. The arching planar member addition to the rear of the planar member is a rearwardly inclined and extended suspension member for attaching built in anti-skid member 3*m*.

The ski rockers in FIGS. 7 through 11 have anti-skid members that are suspended by various inclined and extended suspension members, or attachment mechanisms that attach them from above the supporting surface and substantially to the rear of the forward running surface of the planar member. The extended anti-skid members are suspended in a downward manner from a position adequately above the supporting surface so that they are extended downward when the planar member is in a first normal position resting the normal sliding section of the planar member's running surface in a level manner on the supporting surface.

OPERATION

FIGS. 7 to 11

Alternative Ski Rocker Embodiments

The FIGS. 7 to 11 ski rockers are operated much like the preferred ski rocker. The components function like the related components in the preferred embodiment. The various anti-skid members are used for braking. Welding is the attachment means for fixedly attaching the gripping bars to the pole members. Various attachment mechanisms suspend the anti-skid members from the planar members and/or from the pole members, so that the downward extended anti-skid members are positioned above the supporting surface and substantially to the rear of the normal sliding section of the planar member's running surface. All of these designs fall within the specific parameters that cause an engagement of the anti-skid members at a substantial depth into the supporting surface when rocking the training device back minimally.

CONCLUSIONS

FIGS. 7 to 11

Alternative Embodiments of the Ski Rocker Trainer

From the description and operation above, it is evident that these embodiments of the ski rocker accomplish the objectives set forth above.

Conclusions, Ramifications, and Scope

Figure 3T:
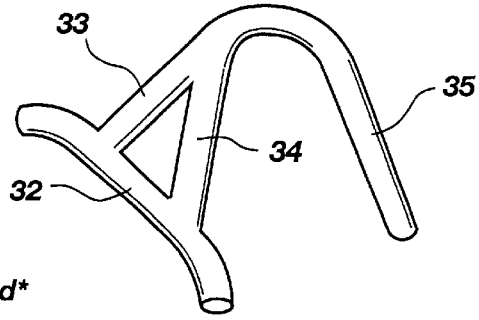

Although the descriptions above contain many specifications, these should not be construed as limiting the scope of the invention but merely providing illustrations of some of the presently preferred embodiments of this invention. Some of the many alternative components and methods for assembling additional embodiments are listed as follows: The downward extended anti-skid members can have many other shapes, such as hooks rounding forward or backward, finger-like probes, or inverted cones. Inverted cones and probes with rounded ends would create less friction than flaps (for braking), and less deflection than fins (for turning). For simplicity, there could be two rather than three planes on the planar member (a green section for sliding fast inclined to a red section for stopping). To float better in powder, and to stand up better on an ice rink for ice skaters, the planar member could be made as wide as a snowboard. For snowboarders, to planar members could be attached to each side of a curved tube member that is split at the bottom. This would provide room for the snowboard between the two planar members. Similarly, a meter wide planar member with a void in its tail could also be substituted for snowboarders. It is anti-skid members would be attached under each side of the inclined planar member's tail (to each side of the void). Additionally, the handle bars can have many other shapes, such as circular, horn like, or triangular. For snowboarders, the triangular handle bar set up shown in FIG. 3T may be substituted for the gripping bars in the preferred embodiment. The triangle handle bar set up is as follows:

Crossbar 32 is welded below handle bars 33 and 34, which are attached to each side of the crossbar's mid section, allowing room for a hand to grasp crossbar 32 between the two handle bars. Handle bars 33 and 34 slope upward (45° from level) and slightly away from crossbar 32 as they slope inward to join (forming a triangle) and then bend downward to form the down tube 35. Down tube 35 is welded inside the top of upper tube 12 in FIG. 1C in place of its "T" piece and gripping bars. A snowboarder riding sideways with his left hand forward may hold the triangular handle bars with his left hand on left handle bar 33, or on the bottom crossbar 32. A right hand forward snowboarder should grasp with his right hand on right handle bar 34.

There are numerous inclined and extended suspension members, or members for attaching and suspending the downward extended anti-skid members from above and to the rear of the normal sliding sections of the planar members' running surfaces. Additionally, the planar member bases may be manufactured with inclines and fins include in a one piece mold. Plastic injection molding could form the fins and bends of such a one piece planar member during mass production. Thus the scope of the invention should be determined by the appended claims and their legal equivalents, rather than by the examples given.

What is claimed:

1. A new and improved hand held training device for snow skiers, and other sliding sports persons for use on supporting surfaces for aiding users to learn and master the skills of their sliding sport comprising of the prior art combination of:

(a) at least one planar member, said planar member having a running surface on bottom with an upwardly rounded front-end, wherein said running surface includes a normal sliding section, whereby said planar member may rest on said normal sliding section of said running surface and slide forward along a supporting surface, (b) a pole member, (c) a first means for mounting said pole member to said planar member, wherein said pole member is attached to said planar member in an inclined and extended position, so as to incline above the supporting surface to the rear of said planar member, (d) at least one gripping bar, (e) a second means for fixedly attaching said gripping bar to said pole member in a predetermined position substantially above said planar member proximal to the top of said pole member, whereby permitting a user to control the hand held training device by at least one of the user's hands, (f) at least one anti-skid member having a scraping edge for engaging the supporting surface, (g) a third means for attaching said anti-skid member to the training device, (h) whereby said anti-skid member engages the supporting surface with at least a minimal amount of penetration when said pole member is rocked substantially back by the user, and an improvement comprising of:

(i) wherein said third means of attachment further includes at least one inclined and extended suspension member for attaching said suspending said anti-skid member from a position above and substantially to the rear of the normal sliding section of said planar member, (j) wherein said suspension member is selected from the group consisting of said pole member and a rearwardly inclined and extended addition to said planar member, (k) wherein said third means of attachment extends downward said anti-skid member when said planar member is in a first normal position resting the normal sliding section of said running surface in a level manner on the supporting surface, (l) whereby said inclined and extended suspension member extends downward said anti-skid member from above and substantially to the rear of the normal sliding section of said planar member, so as to permit said anti-skid member on said suspension member to engage the supporting surface to a substantial depth when minimally rocking back the hand held training device, thereby permitting uses to continuously brake with ease.

2. The training device of claim 1 wherein said anti-skid member is a fin-like anti-skid member, wherein said third means attaches said fin-like anti-skid member such that said scraping edge thereof is pointed forward, thereby permitting the user to simultaneously turn and brake when said pole member is rocked back minimally and said fin-like anti-skid member penetrates the supporting surface.

3. The training device of claim 1 wherein said anti-skid member is a flap-like anti-skid member, wherein said third means attaches said flap-like anti-skid member such that said scraping edge thereof points downward, thereby providing considerable braking in soft snow conditions when said pole member is rocked back and said flap-like anti-skid member engages the supporting surface.

4. The training device of claim 3 wherein said third means for attaching includes a means for adjusting said flap-like anti-skid member, thereby providing alternative flap angles for engaging the supporting surface, so as to permit the user to modify braking intensity for use in various snow conditions.

5. The training device of claim 4 wherein said third means further includes a fin-like anti-skid member such that said scraping edge thereof is pointed forward, thereby permitting the user to simultaneously turn and brake when said pole member is rocked back minimally and said fin-like anti-skid member penetrates the supporting surface.

6. The training device of claim 1 wherein said gripping bar is a short bar, wherein said gripping bar is fixedly attached in a substantially perpendicular manner to said pole member at a predetermined position near the top of said pole member, further including a forearm cuff member that is attached above said gripping bar proximal to the top of said pole member.

7. The training device of claim 6 wherein said inclined and extended suspension member for supporting said anti-skid members is said pole member.

8. The training device of claim 6 wherein said first means for mounting the base of said pole member to said planar member is a pivotal mount, so as to permit movement of said planar member from a level position, wherein said normal sliding section of said running surface slides upon the supporting surface, to a vertical position, wherein the front end extends upwardly adjacent to said pole member with the rare portion of said planar member extended downward.

9. The training device of claim 6 wherein said suspension member is an inclined and extended addition to the aft section of said planar member, with said anti-skid member being attached downward from said suspension member thereof.

10. The training device of claim 1 wherein said at least one gripping bar is attached substantially perpendicularly proximal to the top of said pole member, so as to permit users to grasp said at least one gripping bar as one crossbar with both hands, thereby providing one hand held device for beginner skiers and permitting users to relieve their arms of the braking for by resting said crossbar against their mid-section or thighs.

11. The training device of claim 10 wherein said inclined and extended suspension member for attaching said anti-skid members is said pole member.

12. The training device of claim 11 wherein said anti-skid member is a flap-like anti-skid member, wherein said third means attaches said flap-like anti-skid member such that said scraping edge thereof points downward, thereby providing considerable braking in soft snow conditions when said pole member is rocked back and said flap-like anti-skid member engages the supporting surface.

13. The training device of claim 11 wherein said anti-skid member is a fin-like anti-skid member, wherein said third means attaches said fin-like anti-skid member such that said scraping edge thereof is pointed forward, thereby permitting the use to simultaneously turn and brake when said pole member is rocked back minimally and said fin-like anti-skid member penetrates the supporting surface.

14. The training device of claim 10, wherein said suspension member is a rearwardly inclined and extended addition to the normal sliding section of said planar member, with said anti-skid member being attached downward from said suspension member thereof.

15. The training device of claim 14 wherein said anti-skid member is a flap-like anti-skid member, wherein third means attaches said flap-like anti-skid member such that said scraping edge thereof points downward, thereby providing considerable braking in soft snow conditions when said probe member is rocked back and said flap-like anti-skid member engages the supporting surface.

16. The training device of claim 14 wherein said anti-skid member is a fin-like anti-skid member, wherein said third means attaches said fin-like anti-skid member such that said scraping edge thereof is pointed forward, thereby permitting the use to simultaneously turn and brake when said pole member is rocked back minimally and said fin-like anti-skid member penetrates the supporting surface.

17. A new and improved hand held training device for snow skiers, and other sliding sports persons for use on supporting surfaces for aiding users to learn and master the skills of their sliding sport comprising:

(a) at least one planar member, said planar member having a running surface on bottom with an upwardly rounded front-end, wherein said running surface includes a normal sliding section, whereby said planar member may rest on said normal sliding section of said running surface and slide forward along a supporting surface, (b) a pole member, (c) wherein said pole member is attached said to planar member in an inclined and extended manner, so as to incline above the supporting surface to the rear of said planar member, (d) at least one gripping bar to permit control of said pole member by a user's hand, (e) wherein said gripping bar is attached to said pole member in a predetermined position substantially above said planar member proximal to the top of said pole member, (f) at least one anti-skid member having a scraping edge for engaging the supporting surface, (g) at least one rearwardly inclined and extended suspension member attached to said planar member, for attaching said suspending said anti-skid member from a position above and substantially to the rear of the normal sliding section of said planar member, (h) wherein said suspension member is selected from the group consisting of said pole member and a rearwardly inclined and extended addition to said planar member, (i) wherein said anti-skid member extends downward when said planar member is in a first normal position resting the normal sliding section of said planar member in a level manner on the supporting surface, (j) whereby said inclined and extended suspension member suspends downward said anti-skid member from above and substantially to the rear of the normal sliding section of said planar member, so as to permit said anti-skid member on said suspension member to engage the supporting surface to a substantial depth when minimally rocking back the hand held training device, thereby permitting users to continuously brake with ease.

18. The training device of claim 17 wherein said anti-skid member is a fin-like anti-skid member, wherein said third means attaches said fin-like anti-skid member such that said scraping edge thereof is pointed forward, thereby permitting the user to simultaneously turn and brake when said pole member is rocked back minimally and said fin-like anti-skid member penetrates the supporting surface.

19. The training device of claim 17 wherein said anti-skid member is a flap-like anti-skid member, wherein said third means attaches said flap-like anti-skid member such that said scraping edge thereof points downward, thereby providing considerable braking in soft snow conditions when said pole member is rocked back and said flap-like anti-skid member engages the supporting surface.

* * * * *